United States Patent [19]

Taylor et al.

[11] Patent Number: 4,771,758

[45] Date of Patent: Sep. 20, 1988

[54] AIR WEAPON WITH AIR COMPRESSION SYSTEM HAVING GROOVES FOR AIR TRANSFER

[75] Inventors: Hugh F. Taylor, Sawston; David R. Theobald, St. Ives, both of England

[73] Assignee: Utec B.V., Leersum, Netherlands

[21] Appl. No.: 846,708

[22] Filed: Apr. 1, 1986

Related U.S. Application Data

[63] Continuation-in-part of Ser. No. 552,457, Nov. 16, 1983, Pat. No. 4,709,686, which is a continuation-in-part of Ser. No. 357,331, Mar. 11, 1982, abandoned.

[30] Foreign Application Priority Data

Apr. 1, 1985 [GB] United Kingdom ..... 8508427

[51] Int. Cl.[4] ..... F41B 11/00

[52] U.S. Cl. ..... 124/68; 92/181 R; 92/182

[58] Field of Search ..... 124/66, 67, 68, 69, 124/70; 92/181 R, 182

[56] References Cited

U.S. PATENT DOCUMENTS

| | | | |
|---|---|---|---|
| 1,014,744 | 1/1912 | Bavier | 92/181 R |
| 1,710,011 | 4/1929 | Burnett | 92/182 |
| 2,686,402 | 8/1954 | Samuel | 92/182 X |
| 2,758,586 | 8/1956 | Scalingi | 124/67 |
| 3,302,319 | 2/1967 | Rosselet | 124/67 X |
| 3,385,279 | 5/1968 | Pitcher | 124/67 |
| 4,282,852 | 8/1981 | Omana | 124/67 |

FOREIGN PATENT DOCUMENTS

| | | | |
|---|---|---|---|
| 459817 | 9/1968 | Switzerland | 124/67 |

*Primary Examiner*—Richard T. Stouffer
*Attorney, Agent, or Firm*—Lee & Smith

[57] ABSTRACT

An air weapon air compression system of the type in which air is compressed in a cylinder and expelled through a discharge port, to propel a projectile along the barrel and fire it out of the weapon, by the rapid movement of a piston within the cylinder. Such a system incorporating grooves in one or both of opposed portions of the cylinder and piston, for the transfer of air towards the discharge port during the final compression stage, to enhance the performance of the weapon.

11 Claims, 3 Drawing Sheets

AIR WEAPON WITH AIR COMPRESSION SYSTEM HAVING GROOVES FOR AIR TRANSFER

This application is a continuation-in-part of co-pending U.S. patent application Ser. No. 552,547, filed Nov. 16, 1986, now U.S. Pat. No. 4,709,686 which in turn is a continuation-in-part of U.S. patent application Ser. No. 357,331, filed Mar. 11, 1982, now abandoned.

The present invention relates to air-weapons which, during their firing action, rely on a system including one or more pistons moving rapidly inside a cylinder, thus compressing the air in the cylinder ahead of the piston and forcing it through a transfer or discharge port and then through the barrel, carrying the projectile, typically a pellet, ahead of it. Some estimates suggest that about 75% of the air-weapons sold in the United Kingdom are of this type.

Such systems commonly comprise a piston which, on firing, is moved along a cylinder at high velocity by either a mechanical spring, a gas spring or a replenishable pressure source. These systems must be capable of being re-cocked manually, and since the amount of energy that a person can put in the system is somewhat limited, various attempts have been made to maximise the power output from these compression systems, by improving the efficiency of the process by which the stored energy that moves the piston is transmited to the pellet.

According to a theory that the energy in the compressed air charge is dissipated in the unswept volume of the compression chamber and the discharge port, various configurations of compression chambers and discharge ports have been tried and tested. This has given rise to the general belief that the compression system as a whole operates most efficiently if the unswept volume of the compression chamber is minimised. Subsequent development has led to the common usage of flat-crowned pistons and flat-ended cylinders giving a compression chamber with virtually no unswept volume, incorporating a discharge port which is as short in length as possible and of a diameter that is related to the size of the bore of the barrel.

It is an object of the present invention to provide an improved air weapon air compression system in which the efficiency of the compression system is materially improved over what was previously thought to be the maximised minimum swept volume compression chamber, compression system described above.

A known problem with weapons of this kind is the phenomenon known as "piston bounce". This is the tendency for the piston to bounce off the trapped air between the piston crown and the end of the front end wall of the cylinder at the end of the piston firing stroke. This bounce reduces the smoothness of the firing action and is thought to be a common cause of inaccuracy. Any reduction in piston bounce is therefore, highly desirable.

A number of attempts have been made to reduce piston bounce. In GB patent No 1604456 (Nopek) a complicated mechanical system is described which includes first and second pivotally interconnected levers, the first lever being pivotally connected to the piston and the arrangement being such that the levers are locked substantially in line when the piston is at the maximum extent of its travel.

However this device is cumbersome and is quite likely to have an adverse effect on the performance of the weapon. Another anti-bounce device has been proposed by G. Cardew in which rearward movement of the piston is prevented by a rod which extends backwards from the piston into a tapering chamber containing steel balls. The rod is free to move in the direction of the piston but is prevented from moving backwards by the engagement of the steel balls directly between the rod and the tapered chamber wall. Despite all precautions, frequently upon firing, all the working parts are distorted and the entire unit is forced away from the weapon.

It is therefore a further object of the invention to provide a compression system in which piston bounce is minimised or indeed even avoided altogether.

According to the invention, there is provided an air weapon air compression system comprising at least one piston and cylinder which a discharge port, characterised by one or more grooves provided in the material of one or both of the opposed portions of the cylinder and piston for the transfer of air towards the discharge port during the final compression stage, thereby to enhance the performance of the weapon.

There are preferably a plurality of grooves. While the precise effect of the grooves is not, as yet, fully understood it is believed that they enable the highly compressed air that is not immediately adjacent ot the discharge port to reach the discharge port more rapidly and thus be more readily expelled on the initial stroke of the piston than is the case with the normal piston crown which is flat. This may result in a more efficient performance.

A further advantage of the invention is that, by allowing a higher proporation of the compressed air to escape rapidly via the discharge port, the well-known tendency for the piston to bounce off the trapped air is significantly reduced.

It appears, therefore that the present invention tends to fly in the face of normal criteria for piston design. It is established practice that the power of an air weapon is generally increased by keeping the unswept air volume to a minimum. If fact the invention was made by the inventors at a time when it was intended to reduce the performance of a particular rifle in order to avoid the necessity of the rifle being registered on the fire arms certificate of the customer, which is necessary in the UK if the muzzle energy of the rifle exceeds 12 ft/lbs. In an attempt to reduce the power of this particular rifle without reducing the speed of the piston, grooves were provided in the face of the piston crown to increase the unswept volume but, to the surprise of the inventors, it was discovered that the power of the rifle was increased.

The precise parameters which govern the ideal shape and size of the grooves have not yet been determined but it is anticipated that by careful testing, now the concept of the invention has been realised, it will be possible to determine the disireable characteristics of the grooves in order to achieve the maximum enhancement of the performance of the rifle or other weapon.

Preferably at least one of the grooves is substantially aligned at one point along its length with the discharge port thereby to provide direct communication between the groove or grooves and the port. In one particular configuration three grooves are provided generally in the form of a star, the grooves being symmetrically arranged to radiate from a center point on the end of the piston crown and one of the grooves being aligned with an off-center discharge port in the cylinder.

In an alternative construction, the piston crown has a recess at a position corresponding to the position of the discharge port and the grooves are formed in the piston crown radiating outwards from the recess.

The crown may incorporate a lubricant scraper at its rear end for wiping lubricant from the wall of the cylinder. A resilient seal may be associated with the or each piston and cylinder, one part of which provides an air tight seal between them during compression and another part of which provides a scraper for scraping lubricant from the walls of the cylinder during induction.

The invention may be carried into practice in various ways and one embodiment will now be described by way of example with reference to the accompanying drawings in which.

Figure 1:
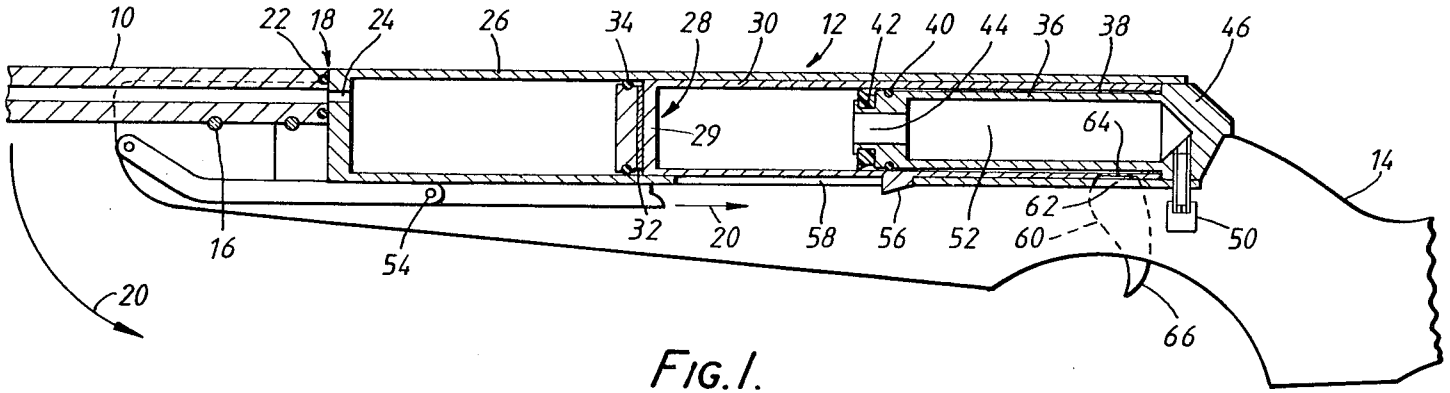
FIG. 1 is a cross-sectional side elevation of a known type of gas spring operated air rifle, with the firing mechanism in the cocked condition.

The illustrated air rifle comprises a barrel 10 in front of a firing mechanism 12 mounted to the stock 14, the latter for convenience being shown only in FIG. 1. The barrel turns about a pivot pin 16 to open a breech 18, as indicated by arrows 20 in FIG. 1, and at the same time cocking the mechanism 12 ready for firing. The barrel 10 closes the breech 18 against a breech seal 22 in the form of an 'O' ring. When the rifle is opened to effect cocking, a pellet is inserted in the breech 18 in accordance with conventional practice.

The firing mechanism 12 comprises an outer steel cylinder 26 the front end wall of which contains discharge port 24 and within which moves part of a gas spring comprising a hollow piston 28 having a cylindrical piston wall 30 which is closed at its left hand end by a wall 29. The piston has a crown damper 32 and piston seal 34 in the form of an 'O' ring behind the piston crown 35. The front part of the cylinder and the piston 28 form the compression system of the weapon.

Within the rear part of the outer cylinder 26 is fixed an inner steel cylinder 36 forming a further part of the gas spring and defining with the outer cylinder 26 an annular clearance 38 within which is received the rear end of the piston wall 30. The inner cylinder 36 is sealed with respect to the bore of the piston 28 at the front end of said cylinder 36 through an "O" ring seal 40 and a lip seal 42.

The lip seal 42 is located in a groove 42A in the protruding end of a short tube 44, the inner end of which is secured by Loctite adhesive in the end of the cylinder 36.

The lip seal is undercut on its face which opens towards the space within the hollow piston 28 so that, when a charge of compressed gas is introduced into the space within the hollow piston 28 and the inner cylinder 36, in a manner to be described, such pressure biasses the peripheral lip of the seal against the inner bore of the piston 28.

It is to be noted that, when the gun is cocked, the piston 28 is moved relatively slowly to the right in the drawings whilst the lip seal 42 remains stationary. This relatively slow movement over the lip seal does not give rise to any difficulties. Nor, when the gun is fired and the piston 28 is moving at high speed to the left, is there any difficulty with the seal 42 since at that time the seal can act as a trailing seal in relation to the bore of the piston. Thus during cocking and firing the lip seal 42 provides an effective and permanent seal, containing the charge of compressed gas against escape.

At its rear end, the inner cylinder 36 is closed by a tailpiece 46 which also serves to close the rear end of the outer cylinder 26. Thus, said tailpiece 46 mates within the rear end of the outer cylinder 26 and is fixed in position by three locking screws 48 which are sealed in position by use of a metal bonding adhesive, such as that known by the Trade Mark Loctite, at the time the screws are inserted and tightened.

Figure 2:
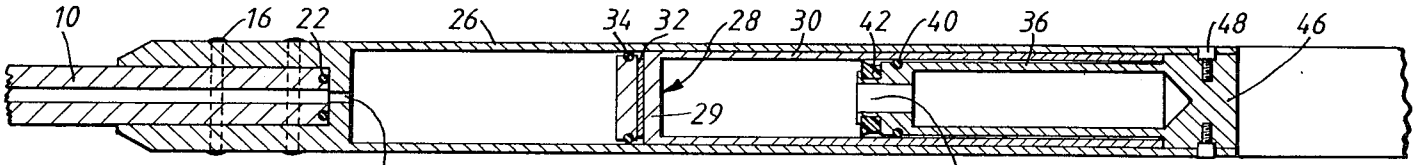
FIG. 2 is a cross-sectional plan of the air rifle shown in FIG. 1.
Figure 3:
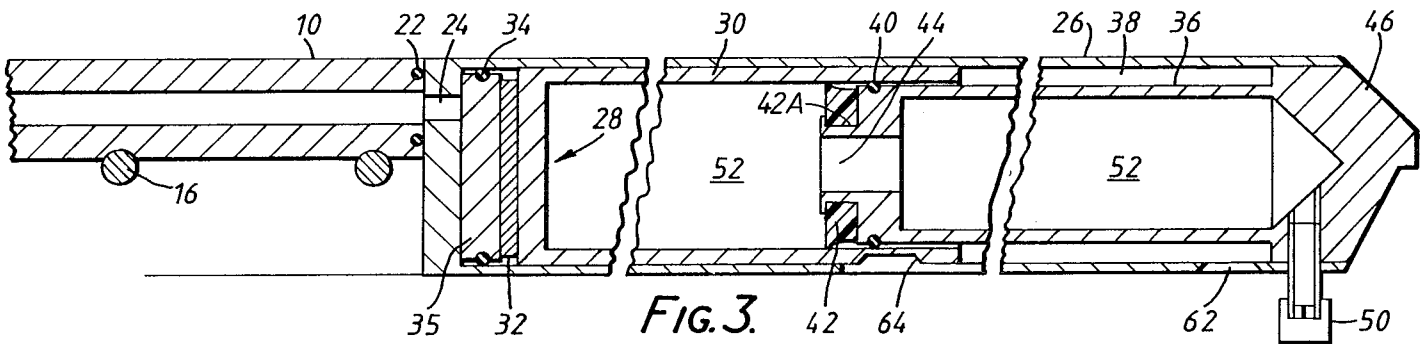
FIG. 3 is a cross-sectional side elevation of the air rifle shown in FIG. 1, to a larger scale and with the firing mechanism in the uncocked condition.
Figure 4:
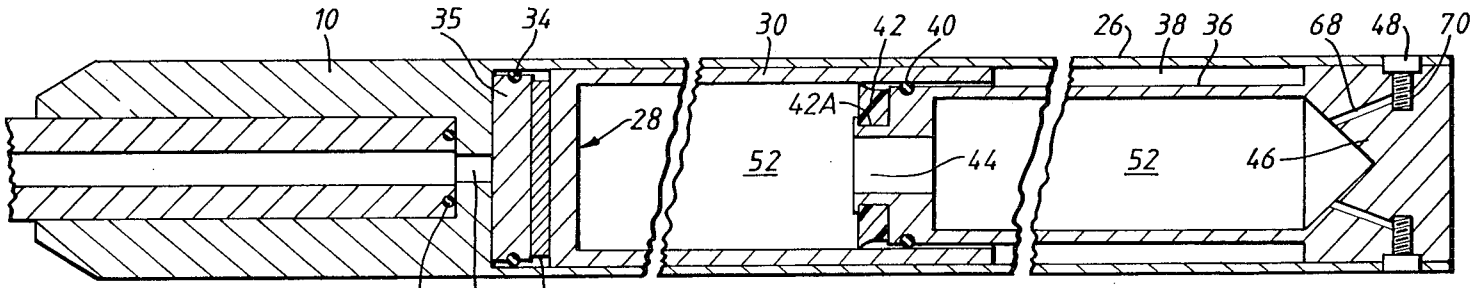
FIG. 4 is a cross-sectional plan view of the air rifle as shown in FIG. 3.

By means of a Schraeder type valve 50 (see FIG. 3) in the rear closure 46, a charge of high pressure gas, e.g. air or carbon dioxide, or an inert gas which has no effect on the lip seal 42, can be forced into the sealingly closed variable volume chamber 52 defined by the communicating interiors of the inner cylinder 36 and the hollow piston 28. When the mechanism is uncocked (see FIGS. 3 and 4), the piston 28 is disposed in its most forward position and the chamber 52 has a maximum volume. When the mechanism is cocked (see FIGS. 1, 2 and 5), the piston 28 is in its most rearward position and the chamber 52 has a minimum volume, which is about two thirds of its maximum volume in the uncocked condition.

The mechanism 12 is cocked when the breech 18 is opened by pivoting the barrel 10. A cocking lever mechanism 54 driven by the pivoting barrel moves rearwardly, in turn pushing the piston 28 rearwardly through the intermediary of a lug 56 on said piston which projects through a longitudinal slot 58 in the outer cylinder 26. When the piston 28 reaches its most rearward position, in which the charge of gas in the chamber 52 is under very high compression, it is latched in position by a spring loaded trigger mechanism 60 having a sear which engages through a slot 62 in the outer cylinder into a recess 64 in the wall 30 of the piston. The air rifle is now ready to be fired by pulling the trigger 66.

When the rifle is fired by pulling the trigger, the piston latch or sear is released, and the piston 28 is driven rapidly forward under the pressure of the highly compressed gas in the chamber 52. Air in the outer cylinder 26 in front of the piston 28 is increasingly compressed until it exceeds a threshold which fires the pellet out of the breech along the barrel. Because of the rapid compression of the air in the cylinder 26, and the relatively small area of the discharge port 24, through which the air has to pass in order to fire the pellet, not all the air in the cylinder 26 is immediately expelled down the barrel. It is believed that only the air in the immediate vicinity of the discharge port 24 is expelled on the initial forward stroke of the piston 28. The remainder of the air is trapped between the piston crown 35 and the front end wall of the cylinder 26 forming a highly compressed cushion of air which at a certain stage causes the piston 28 to bounce back, rearwardly, along the cylinder 26. This rearward bounce continues until the pressure of the air cushion is reduced sufficiently to be overcome by the force of the gas spring whereupon the piston 28 commences to move forwards again. By this stage a sufficient time delay has occurred to enable substantially all the air to be expelled on the second forward stroke of the piston 28. However, the firing of the pellet commences with the initial discharge of air, therefore if a greater portion of the air charge could be discharged initially the power going into firing the pellet would be increased. By substituting the type of piston crown 135 shown in FIGS. 5 and 7 for the flat piston crown 35 it is believed that such an increased initial discharge of air is accomplished and the compression system is improved.

Figure 5:
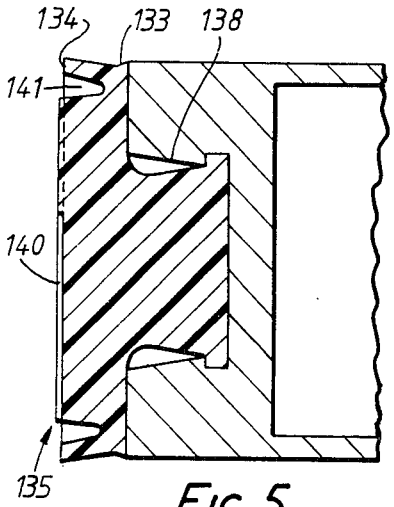
FIG. 5 is a sectional side elevation to a larger scale of an improved crown piece in a piston for the air rifle shown in FIG. 1.
Figure 6:
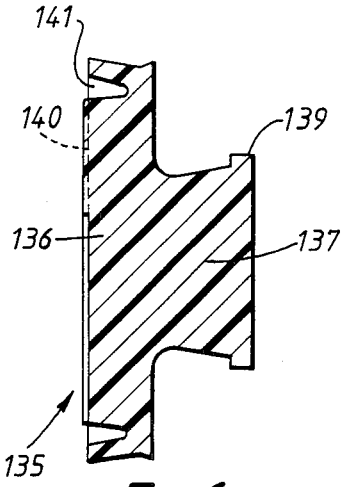
FIG. 6 is a sectional side elevation of the crown piece shown in FIG. 5.

The improved piston crown 135 is comprised of a head portion 136 and a plug portion 137 and is made of a resilient polyurethane material for example HYTREL. The plug portion 137 is shaped to facilitate insertion and location of the crown 135 within a bore 138 which is formed in the front end of the piston 28, as shown in FIG. 5. A flange 139 at the end of the plug 137 locates in a groove in the bottom of the bore 138. Because the crown 135 is made of resilient material, a crown damper, such as 32 is not required, and instead of the 'O' ring seal 34 a lip seal 134 is provided integrally with the crown 135. The trailing edge of the lip seal 134 is flared outwardly towards the cylinder wall to provide a lubricant scraper 133 so that lubricant on the cylinder wall is scraped away from the compression chamber as the firing mechanism is cocked. This scraping of lubricant assists in preventing 'dieseling' of the weapon as it fires, which is caused by spontaneous ignition of lubricant within the compression chamber. Three grooves 140 in the front face of the head portion are arranged in a Y configuration to provide air flow channels across the face of the piston. These grooves 140 interconnect a circumferential groove 141, which is adjacent the lip seal 134, to a position along one of the grooves 140 which is arranged to be adjacent the discharge port 24 when the piston 28 is in the uncocked position. The orientation of the crown 135 in relation to the piston 28 so that one of the grooves 140 is aligned with the discharge port 24, is achieved on assembly of the weapon, and the resilient grip of the plug 137 within the bore 138 suffices to maintain this orientation. However a positive orientation could easily be achieved, for example by mating a protruding peg, integral with the crown 135, into a mating bore in the piston.

It is believed that the grooves 140 serve to enhance the flow of air across the face of the crown 135 thereby enabling more air to be expelled on the initial stroke of the piston 28 than is possible with the flat crowned pistons. Therefore although the compression chamber volume has been increased in contradiction to the established practice, the power and smoothness of the weapon is enhanced.

While the invention has been show as applied to a gas spring operated air rifle it will be appreciated that it could be applied to other kinds of air weapons such as mechanical spring or replenishable pressure source operated air rifles, as well as air pistols.

Figure 7:
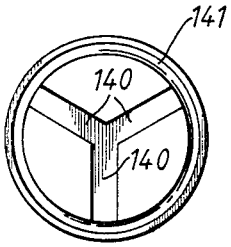
FIG. 7 is a smaller scale end elevation of the crown piece shown in FIG. 5.
Figure 8:
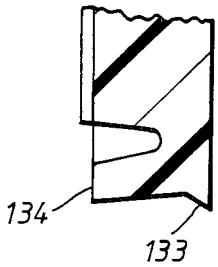
FIG. 8 is an enlarged detail scrap sectional view of the crown piece shown in FIG. 5.
Figure 9:
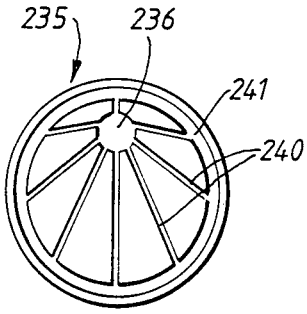
FIG. 9 is a view similar to FIG. 7 showing an alternative embodiment of a crown piece.

An alternative form of piston crown 235 is shown in FIG. 7. In this case a recess 236 is provided in a position which will coincide with the position of the discharge outlet 24. A series of grooves 240 radiate outwards to the circumferential groove 241 from the recess 236, meeting the groove 241 at substantially equispaced positions.

Figure 10:
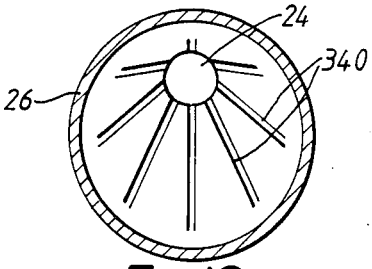
FIG. 10 is a view of the front end wall of the cylinder illustrating a further embodiment of the invention.

Yet another embodiment is illustrated in FIG. 10 which shows the front end wall of the cylinder 26. As can be seen, grooves 340 are formed in the cylinder wall, radiating outwards from the discharge port 24.

Obviously numerous modifications and variations of the present invention are possible on the light of the above teachings. It is therefore to be undersood that within the scope of the appended claims, the invention may be practiced otherwise than as specifically described herein.

We claim:

1. In an air weapon provided with a barrel and a discharge port which is adapted to have compressed air expelled therethrough to propel a projectile along said barrel and out of said weapon, an air compression system for compressing said air, said air compression system comprising a cylinder, at least one piston slidably located within said cylinder, said at least one piston having a piston crown and said cylinder having an end wall opposed to said piston crown, said end wall defining said discharge port which opens into said cylinder; wherein the improvement comprises shallow groove means in the form of elongate depressions formed in the material of and generally parallel to, the plane of at least one of said opposed piston crown and said end wall, said groove means being open to the cylinder along their length, said groove means including at least one groove which is aligned at one point along the length thereof with said discharge port thereby providing direct communication between said groove and said discharge port to allow for the transfer of air towards the discharge port during a final compression stage of said air in said cylinder by said at least one piston thereby to enhance the performance of said weapon.

2. An air compression system according to claim 1 wherein said groove means comprises a plurality of grooves in addition to said at least one groove formed in said piston crown.

3. An air compression system according to claim 1 wherein said groove means further comprises a plurality of grooves formed in said end wall of said cylinder.

4. An air compression system according to claim 1 wherein said groove means including said at least one groove comprises three grooves generally in the form of a star, the grooves being symmetrically arranged to radiate from a center point in the end of said piston crown.

5. An air compression system according to claim 1 wherein said groove means further comprises a recess formed in said piston crown at a position corresponding to the position of said discharge port in said end wall of said cylinder, and said at least one groove comprises a plurality of grooves radiating outwards from said recess in said piston crown.

6. An air compression system according to claim 1 wherein said piston crown incorporates a lubricant scraper on its end remote from said end of said cylinder, said scraper being adapted for wiping lubricant from a side wall of said cylinder upon movement of said piston crown.

7. An air compression system according to claim 1 including a resilient seal associated with said at least one piston and said cylinder, one part of said seal providing an air tight seal between said at least one piston and said cylinder during compression and another part of said seal providing a scraper for scraper lubricant from a cylindrical wall of said cylindrical during induction.

8. In an air weapon providing with a barrel and a discharge port which is adapted to have compressed air expelled therethrough to propel a projectile along said barrel and out of said weapon, an air compression system for compressing said air, said air compression system comprising a cylinder, and at least one piston slidably located within said cylinder, said at least one piston having a piston crown and said cylinder defining said discharge port which opens into said cylinder; wherein the improvement comprises shallow groove means in the form of elongate depressions formed in the material of and generally parallel to, the plane of said piston crown, said groove means being open to the cylinder along their length, said groove means including at least one groove which is aligned at one point along the length thereof with said discharge port thereby providing direct communication between said groove and said discharge port to allow for the transfer of air towards the discharge port during a final compression stage of said air in said cylinder by said at least one piston, thereby to enhance the performance of said weapon.

9. An air compression system according to claim 8 wherein said groove means further comprises a recess formed in said piston crown at a position corresponding to the position of said discharge port in said cylinder, and said at least one groove comprises a plurality of grooves radiating outwards from said recess in said piston crown.

10. An air compression system according to claim 8 wherein said piston crown incorporates a lubricant scraper around its perphery at a position which is axially spaced from said groove means, said scraper being adapted for wiping lubricant from a side wall of said cylinder upon movement of said piston crown.

11. An air compression system according to claim 8 including a resilient seal associated with said at least one piston and said cylinder, one part of said seal providing an air tight seal between said at least one piston and said cylinder during compression and another part of said seal providing a scraper for scraping lubricant from a cylindrical wall of said cylinder during induction.

* * * * *